US005458513A

United States Patent [19]

Matsuoka

[11] Patent Number: 5,458,513

[45] Date of Patent: Oct. 17, 1995

[54] ELECTRIC CONTACTOR

[75] Inventor: Noriyuki Matsuoka, Yokohama, Japan

[73] Assignee: Yamaichi Electronics Co., Ltd., Tokyo, Japan

[21] Appl. No.: 266,656

[22] Filed: Jun. 28, 1994

[30] Foreign Application Priority Data

Jun. 30, 1993 [JP] Japan ..... 5-188960

[51] Int. Cl.[6] ..... H01R 11/22

[52] U.S. Cl. ..... 439/857

[58] Field of Search ..... 439/857, 856, 439/924, 842

[56] References Cited

U.S. PATENT DOCUMENTS

| | | | |
|---|---|---|---|
| 2,289,172 | 7/1942 | Beal | 439/857 |
| 3,792,420 | 2/1974 | Könnemann et al. | 439/857 |
| 3,850,500 | 11/1974 | Cobaugh et al. | 439/851 X |
| 3,945,710 | 3/1976 | Gartland, Jr. | 439/857 |
| 4,283,108 | 8/1981 | Fischer | 439/857 X |
| 4,422,703 | 12/1983 | Christensen et al. . | |
| 4,585,295 | 4/1986 | Ackerman | 439/857 |
| 4,648,669 | 3/1987 | Marks et al. . | |
| 4,988,310 | 1/1991 | Bright et al. . | |
| 5,092,789 | 3/1992 | Sinclair . | |
| 5,167,544 | 12/1992 | Brinkman et al. | 439/856 |
| 5,213,530 | 5/1993 | Uratsuji . | |
| 5,299,950 | 4/1994 | Kaneko . | |

FOREIGN PATENT DOCUMENTS 63-4370 7/1985 Japan .

OTHER PUBLICATIONS

IBM Tech. Bulletin vol. 15 #2 Jul. 1972 Uberbacher.

*Primary Examiner*—William Briggs
*Attorney, Agent, or Firm*—Wenderoth, Lind & Ponack

[57] ABSTRACT

An electric contactor comprises a first resilient contact element and a second resilient contact element extending in an opposing relation to each other. The first and second resilient contact elements are connected together at first ends thereof and open at the second ends thereof. The first and second resilient contact elements are provided the second ends thereof with a first press contact portion and a second press contact portion, respectively, for resiliently clamping a lead pin of an electric part therebetween, the first and second press contact portions being arranged in such a manner as to be positionally displaced with respect to each other in a direction axially of the lead pin, and such that a spring portion extending from the first press contact portion to the connecting end thereof is different in length from a spring portion extending from the second press contact portion to the connecting end thereof. A spring constant of the first resilient contact element is generally equal to a spring constant of the second resilient contact element.

2 Claims, 7 Drawing Sheets

ELECTRIC CONTACTOR

BACKGROUND OF THE INVENTION

1. Field of the Invention

This invention relates to an electric contactor suitable to for use in achieving an electrical connection with a lead pin many of which are designed to project downwardly from an electric part such as a pin grid array type IC of high density.

2. Prior Art

Heretofore, in an electric contactor of the type mentioned above, lead pin clamping portions are formed by bending a punched-out plate to form a pair of resilient contact elements arranged in an opposing relation with a very small distance between opposing surfaces of the pair of resilient contact elements. By forming the distance between the clamping portions comparatively small relative to the thickness (diameter) of the lead pin formed of a round pin, many of which highly densely project from a lower surface of the body of an electric part such as an IC, it becomes possible that when the lead pin is introduced between the pair of resilient contact elements, i.e., into the very small gap between the lead pin clamping portions, the pair of resilient contact elements are displaced outwardly against the resiliency thereof and the lead pin is clamped generally on its same circumferential surface by the restoring force of the pair of resilient contact elements, thereby achieving an electric connection.

However, electric parts such as ICs, which have recently become more and more highly integrally formed, are obliged to have smaller lead pins than ever in order to fulfil the requirement for arranging and projecting the lead pins at very small pitches and in high density. Therefore, electric contactors are also required to be made smaller than ever, and this makes it necessary to reduce the small distance between the pair of resilient contact elements (lead pin clamping portions) to the extent possible.

However, in the process for forming such very small electric contactor, there is a limit to the reduction of the distance between the lead pin clamping portions compared with the reduction of the size of the lead pin. Therefore, it frequently happens that the distance between a pair of lead pin clamping portions in one electric contactor is not equal to that of another electric contactor. This naturally results in insufficient reliability in clamping pressure of the lead pin clamping portions.

The conventional electric contactor encounters another inconvenience when a metal plating is applied to an electric contactor after the completion of shaping of the electrical contactor. If the electric contactor, which is to be subjected to metal plating, has lead pin clamping portions which are held in an opposing relation with a very small distance therebetween or which are somehow in abutment relation, there is a fear that an inferior metal plating will result. This eventually leads to an insufficient electrical connection (i.e., lack of reliability) between the contactor and a lead pin of an electric part. With respect to a technique for reducing the distance between the pair of resilient contact elements by means of bending the contactor, there is also a technical limit and it is extremely difficult to manufacture an electric contactor with high precision.

SUMMARY OF THE INVENTION

It is therefore an object of the present invention to provide an electric contactor which is provided with an improved means for elastically clamping a lead pin of an IC.

To achieve the above object, there is essentially provided an electric contactor comprising a first resilient contact element and a second resilient contact element extending in an opposing relation to each other, the first and second resilient contact elements being connected together at first ends thereof and open at the second ends thereof, the first and second resilient contact elements being provided at the second ends thereof with a first press contact portion and a second press contact portion, respectively, for resiliently clamping a lead pin of an electric part therebetween, the first and second press contact portions being arranged in such a manner as to be positionally displaced with respect to each in a direction axially of the lead pin, a spring portion extending from the first press contact portion to the connecting end thereof being different in length from a spring portion extending from the second press contact portion to the connecting end thereof, a spring constant of the first resilient contact element being generally equal to a spring constant of the second resilient contact element.

The first contact portion and the second contact portion may be extended in opposite directions with respect to each other slightly beyond a center line of the electric contactor.

The resilient contact element having a short spring length may be narrower in width than the other resilient contact element.

If, as shown in FIG. 8, a pair of resilient contact elements a and b forming the lead clamping portions of the electric contactor are designed such that press contact portions c and d thereof are positionally displaced in a direction axially of an axis X of a lead pin e so that a spring length of the resilient contact element a is different from that of the resilient contact element b, thereby enabling separation of the press contact positions relative to the lead pin e, the working condition essentially required in the prior art for reducing the distance between the lead pin clamping portions can be eliminated, the existing requirement for making the lead pin smaller than ever can effectively be met, and a metal plating can appropriately be applied to the clamping portions.

In the case where the press contact portions c and d are positionally displaced in the direction of the axis X, it is difficult to clamp the lead pin e with uniform clamping force or pressure because the displacement amounts are not uniform due to difference in resiliency between the resilient contact elements a and b when the lead pin e is clamped. As shown in FIG. 8, a center line Y of the electric contactor is not in alignment with the axis X of the lead pin, with the result that an undue load is imposed on the lead pin e and an undue load is imposed on one of the resilient contact elements a and b, thus creating an unreliable electrical connection. However, the present invention overcome the above problem by setting a spring constant of the first resilient contact element generally equal to a spring constant of the second resilient contact element by changing the width of the first resilient contact element relative to the width of the second resilient contact element while making it possible to employ an arrangement in which the lead pin clamping portions (press contact portions c and d) are vertically positionally displaced. As a result, a clamping of the lead pin made by the electric contactor, as well as an electrical connection between the electric contactor and the lead pin, can be made correctly.

More specifically, according to the present invention, when the lead pin of the electric part is introduced between the first and second resilient contact elements of the electric contactor, the first press contact portion of the first resilient contact element and the second press contact portion of the second resilient contact element are brought into contact with the lead pin at locations positionally displaced in a direction axially of the lead pin, the first and second resilient contact elements are flexed outwardly with a generally equal displacement amount against resiliency thereof, and the restoring force allows the first and second resilient contact elements to uniformly press the lead pin sideways so that the lead pin is clamped by the electric contactor on a line where the center line Y of the electric contactor is in alignment with the axis X of the lead pin.

Since the first and second press contact portions having a generally equal spring constant are positionally displaced in a direction axially of the lead pin, the lead pin can always be clamped with a uniform contact pressure irrespective of the thickness (diameter) of the lead pin.

Also, since the electric connector of the present invention has the first and second press contact portions which are vertically separately arranged, a metal plating can appropriately be applied to the first and second press contact portions.

BRIEF DESCRIPTION OF THE DRAWING

The present invention will be understood more fully from the detailed description given herebelow and from the accompanying drawings of the preferred embodiments of the invention, which, however, should not be taken to be limitative to the invention, but are for explanation and understanding only.

DETAILED DESCRIPTION OF THE EMBODIMENT

Figure 1B:
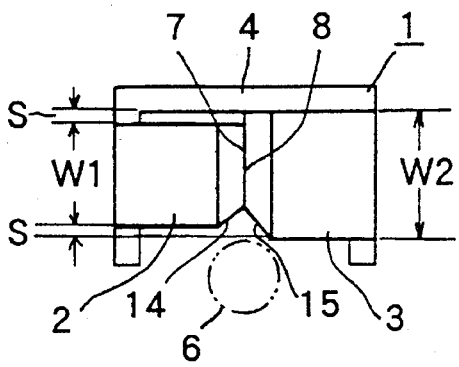
FIG. 1(B) is a plan view thereof.

Embodiments of the present invention will now be described in detail with reference to FIGS. 1 through 7 inclusive.

Reference numeral 1 denotes an electric contactor for achieving an electrical connection by clamping a lead pin many of which are arranged and allowed to project from a lower surface of a body of an electric part such as an IC at very small pitches and at a high density. Although not illustrated, a number of electric contactors 1 are highly densely implanted in a socket body for an electric part and male terminals 5 thereof are allowed to project from a lower surface of the socket body so as to be subjected to electrical connection with a wiring board or the like.

Figure 1C:
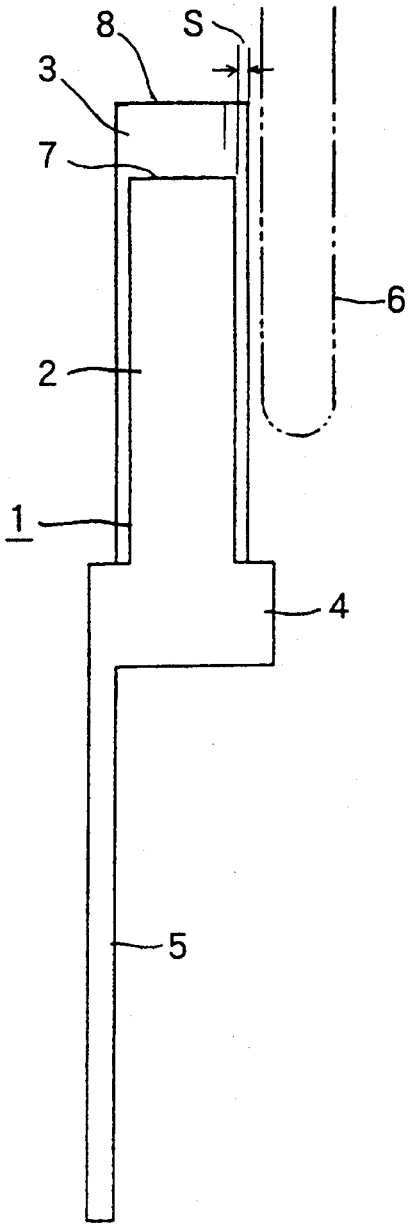
FIG. 1(C) is a side view thereof.
Figure 1A:
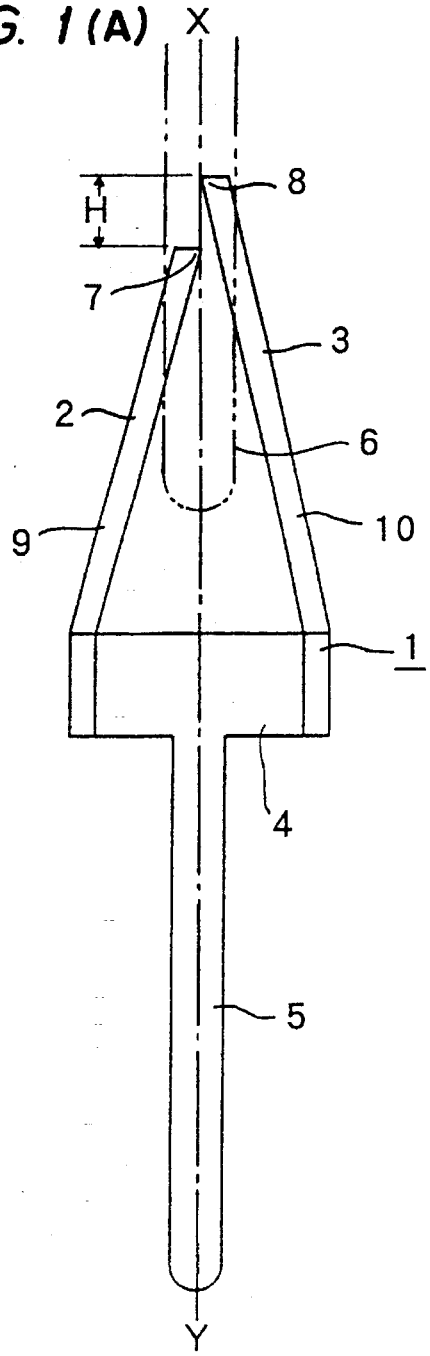
FIG. 1(A) is a front view of an electric contactor according to one embodiment of the present invention.

As shown in FIG. 1, the electric contactor 1 includes a first resilient contact element 2 and a second resilient contact element 3 extending in an opposing relation. First ends (upper ends) of the first and second resilient contact elements 2 and 3, which are in an opposing relation, are open, and second ends (lower ends) thereof are connected together through a connecting plate 4. A male terminal 5 is allowed to extend generally from a center of the connecting plate 4 in a direction opposite to the extending direction of the first and second resilient contact elements 2 and 3 so as to be subjected to an electrical connection with the wiring board.

The first resilient contact element 2 and the second resilient contact elements 3 are inclined forwardly in opposing directions to define a first press contact portion 7 and a second press contact portion 8, respectively, so that a lead pin 6 of the electric part is resiliently clamped by inner edges of the open ends of the first and second resilient contact elements 2 and 3. The first and second press contact portions 7 and 8 are positionally displaced with respect to each other along an axial direction of the lead pin 6. The length of a spring portion a extending from the first press contact portion 7 to the connecting plate 4 is different the length of a spring portion 10 extending from the second press contact portion 8 to the connecting plate 4.

Specifically, the length of the first spring portion 9 of the resilient contact element 2 is set shorter than the length of the spring portion 10 of the second resilient contact element 3. The first press contact portion 7 occupies a lower position and the second press contact portion 8 occupies a higher position so that there is a difference H in height between the first and second press contact portions 7 and 8. The first resilient contact element 2 and the second resilient contact element 3 are inclined forwardly in opposing directions, so that the first and second press contact portions 7 and 8 are arranged on an axis X of the lead pin 6. In other words, the first and second press contact portions 7 and 8 are arranged on a center line Y of the electric contactor 1 so as to be vertically spaced apart along the center line Y.

Figure 2:
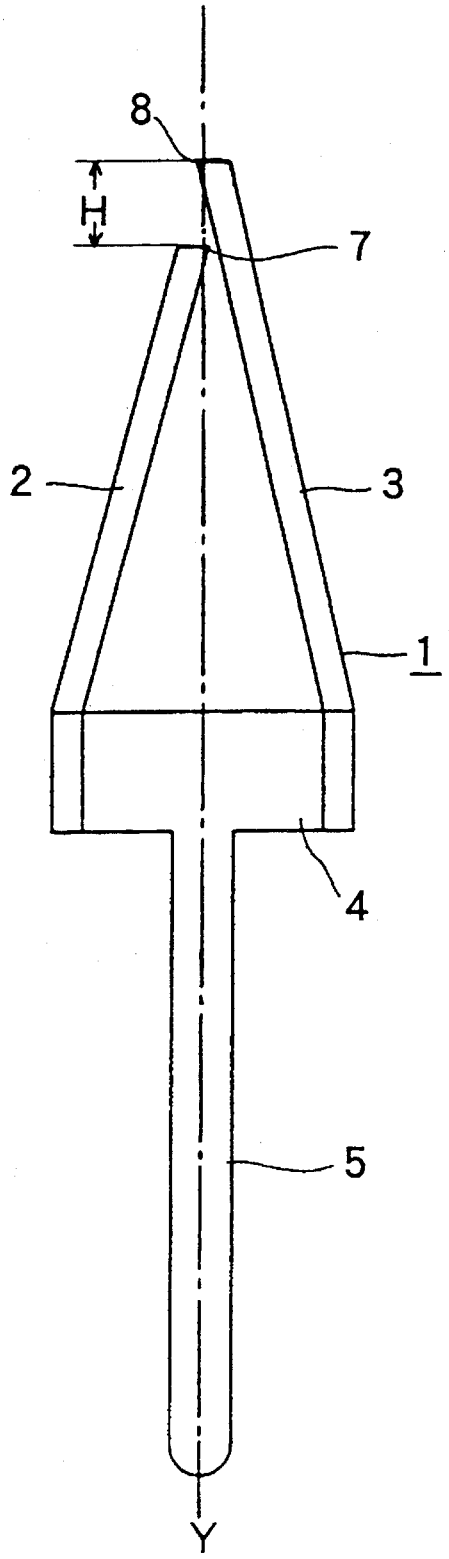
FIG. 2 is a front view showing another example of the press contact portions of the electric contactor of FIG. 1.

As another example, as shown in FIG. 2, the first press contact portion 7 and the second press contact portion 8 are allowed to extend in opposite directions, slightly beyond the center line Y of the electric contactor 1 so that the first and second press contact portions 7 and 8 are overlapped with each other with a difference H in height left therebetween.

In the electric contactor 1, a spring constant of the first resilient contact element 2 is set generally equal to a spring constant of the second resilient contact element 3. In this case, the first resilient contact element 2, which is shorter than the second resilient contact element 3, is formed narrower in width than the second resilient contact element 3 from the open end thereof to the connecting end so that the spring constants of the first and second resilient contact elements 2 and 3 become generally equal.

More specifically, a width $W_1$ of the first resilient contact element 2 is formed narrower than a width $W_2$ of the second resilient contact element 3 so that a step S is formed between first sides of the first and second resilient contact elements 2 and 3 and a step S is also formed between second sides of the first and second resilient contact elements 2 and 3.

Furthermore, the first sides of the first and second resilient contact elements 2 and 3, i.e., the lead pin 6 introducing sides, are defined by tapered portions 14 and 15, respectively, which are gradually converged. An inlet port for the lead pin 6 is defined by the tapered portions 14 and 15 and the step S.

Figure 3:
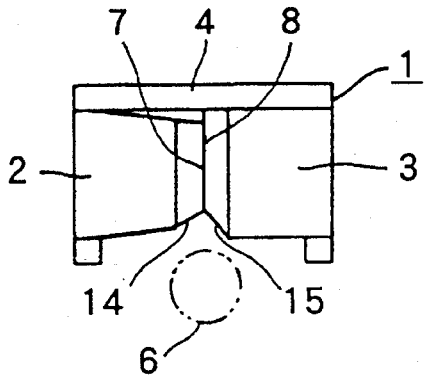
FIG. 3(A) is a front view showing another example of the resilient contact elements of the electric contactor of FIG. 1.
FIG. 3(B) is a plan view thereof.
FIG. 3(C) is a side view thereof.
Figure 3:
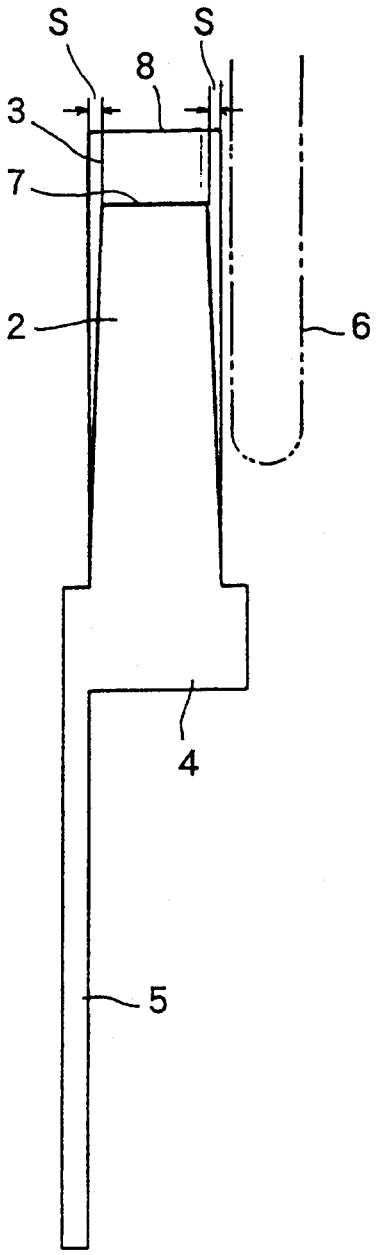
Figure 3A:
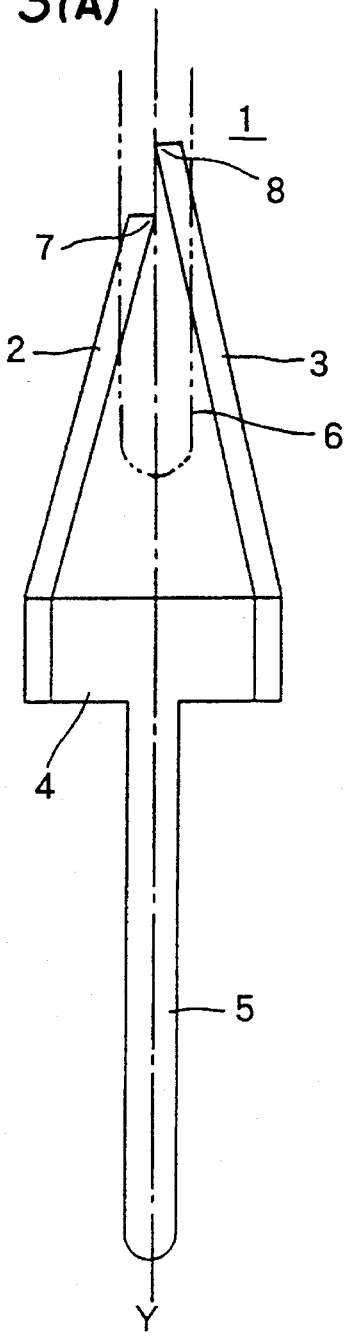

As another embodiment, as shown in FIG. 3, the first resilient contact element 2 is formed gradually narrower in width from the connecting end toward the open end, and both sides of the first resilient contact element 2 are inclined in the opposing directions to form a step S between first sides of the first and second resilient contact elements 2 and 3 and a step S between second sides of the first and second resilient contact elements 2 and 3. The first sides of the first and second resilient contact elements 2 and 3 are defined by tapered portions 14 and 15, respectively. An inlet port for the lead pin 6 is defined by the tapered portions 14 and 15, the step S, and the inclined side edges.

As described above, by properly designing or setting the configuration, thickness, etc. of the first resilient contact element 2 of the electric contactor 1, the spring constant of the first resilient contact element 2 is set Generally equal to the spring constant of the second resilient contact element 3.

The electric contactor 1 thus constructed is implanted in a socket body for an electric part. After the lead pin 6 of the electric part is inserted from the side between the first and second resilient contact elements 2 and 3, the lead pin 6 is laterally moved together with the electric part so as to be introduced between the first and second resilient contact elements 2 and 3. The lead pin 6 thus introduced is clamped between the first and second resilient contact elements 2 and 3 to provide an electrical connection.

Figure 4B:
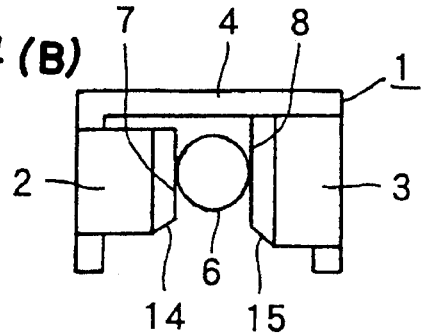
FIG. 4(B) is a plan view thereof.
Figure 4A:
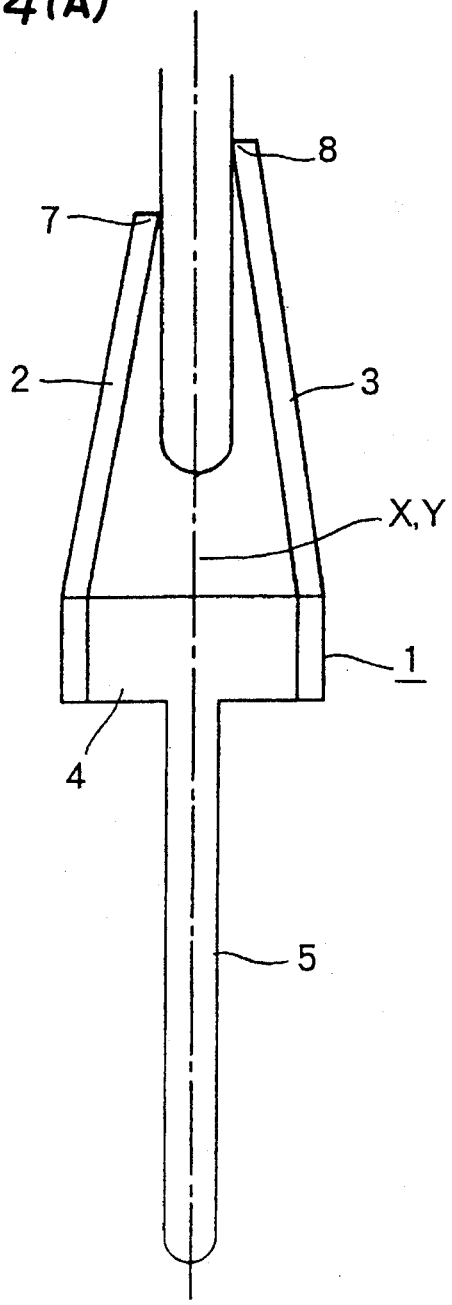
FIG. 4(A) is a front view showing a lead pin introduced into the electric contactor of FIG. 1.
Figure 5B:
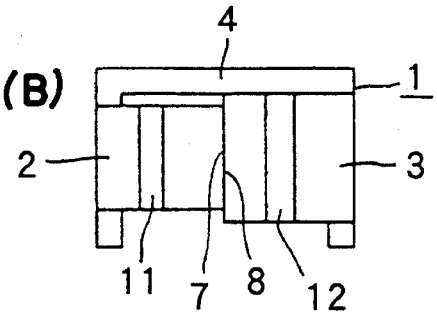
FIG. 5(B) is a plan view thereof.
Figure 5C:
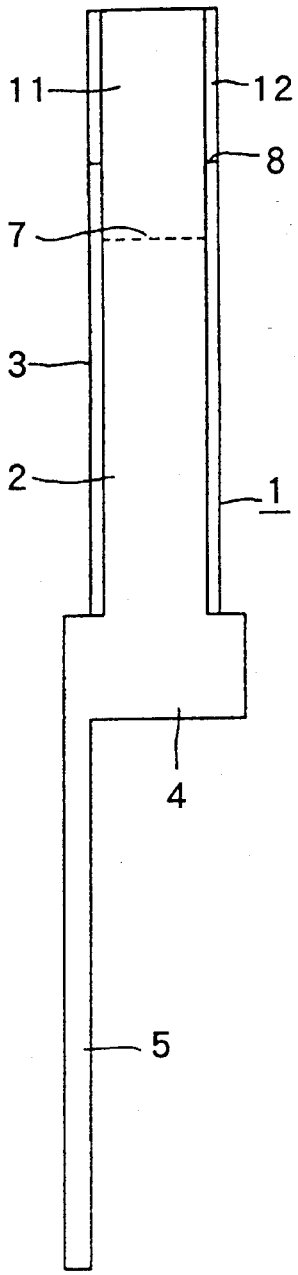
FIG. 5(C) is a left side view thereof.
Figure 5A:
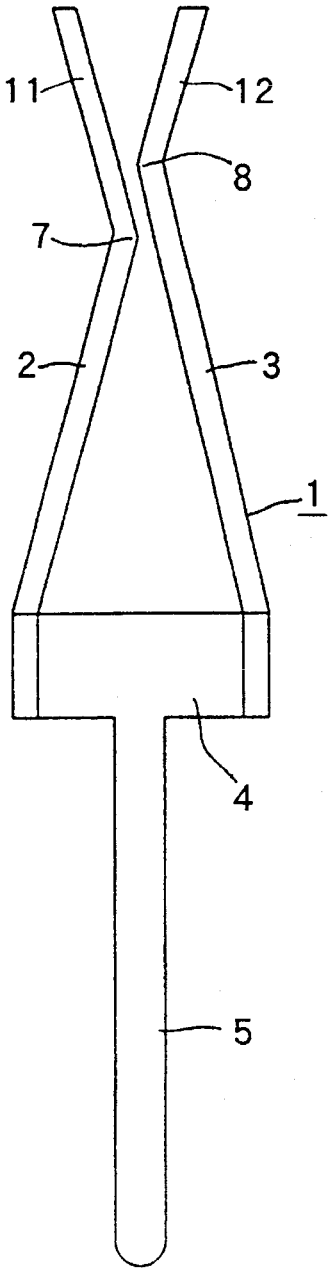
FIG. 5(A) is a front view showing an electric contactor according to another embodiment of the present invention.
Figure 5D:
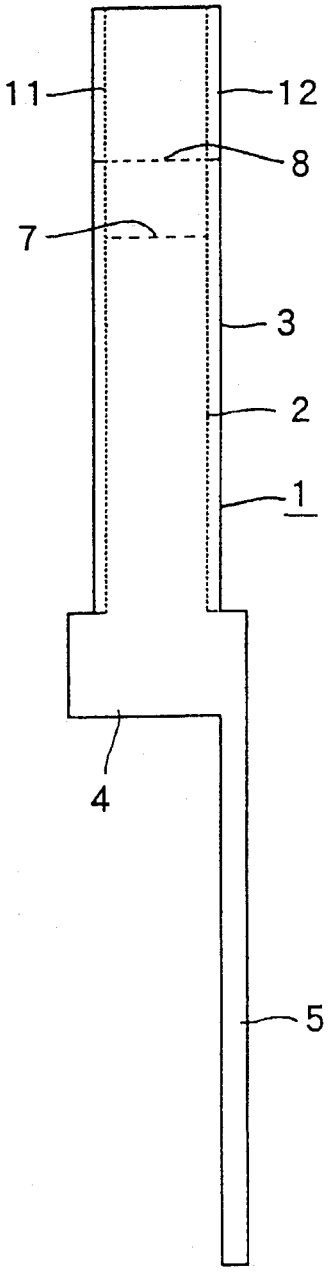
FIG. 5(D) is a right side view thereof.
Figure 6B:
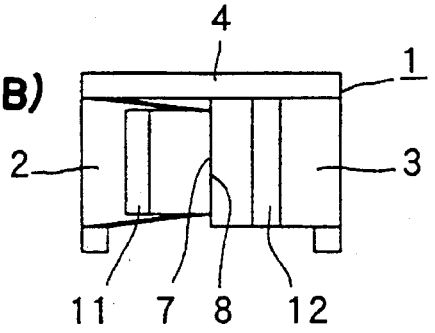
FIG. 6(B) is a plan view thereof.
Figure 6C:
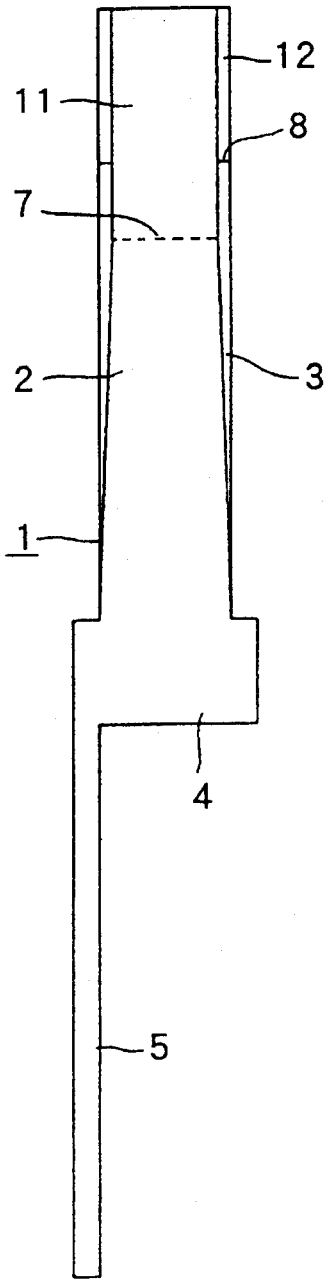
FIG. 6(C) is a left side view thereof.
Figure 6A:
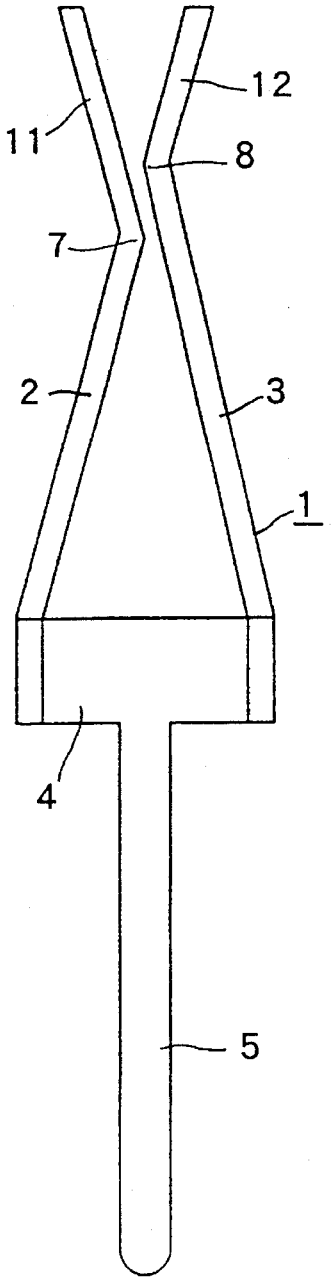
FIG. 6(A) is a front view showing a modified embodiment of the electric contactor of FIG. 5.
Figure 6D:
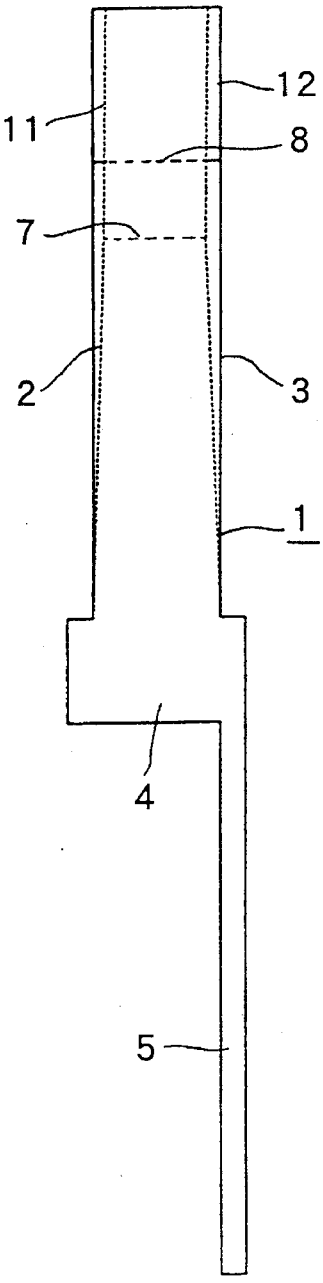
FIG. 6(D) is a right side view thereof.

Specifically, as shown in FIG. 4, when the lead pin 6 is laterally moved from the insert position, the lead pin 6 is brought into contact first with the tapered portion 15 to cause the second resilient contact element 3 to be displaced rearwardly against the resiliency of the second resilient contact element 3. In this manner, the lead pin 6 is brought into contact with the tapered portion 14 to cause the first resilient contact element 2 to be displaced backwardly against the resiliency of the first resilient contact element 2. Then, the lead pin 6 is introduced between the first and second press contact portions 7 and 8 of the first and second resilient contact elements 2 and 3. As mentioned before, while the first and second press contact portions 7 and 8 form contact points relative to the lead pin 6 at locations displaced in the direction of the axis X of the lead pin 6, the first and second resilient contact elements 2 and 3 are press contacted with opposite sides of the lead pin 6 with a generally equal resilient force. That is, the first and second press contact portions 7 and 8 resiliently clamp the lead pin 6 on a line where the axis X of the lead pin 6 and the center line Y of the electric contactor 1 are in alignment with each other.

FIGS. 5 and 6 show embodiments in which the lead pin 6 of the electric part is inserted directly between the first and second resilient contact elements 2 and 3 from above the electric contactor 1 in order to provide an electrical connection. The electric contactor 1 is provided with a first pressure receiving element 11 and a second pressure receiving element 12 which are connected respectively to the open ends of the first and second resilient contact elements 2 and 3. The first and second pressure receiving elements 11 and 12 are gradually inclined outwardly such that a dimension of a space formed therebetween is gradually increased upwardly in order to facilitate an easy introduction of the lead pin 6. The first and second press contact portions 7 and 8 are defined by inner edge portions formed by this connecting portion. The lead pin 6 is interposed between the first and second contact portions 7 and 8 with the first and second pressure receiving elements 11 and 12 serving as a guide means.

Figure 7A:
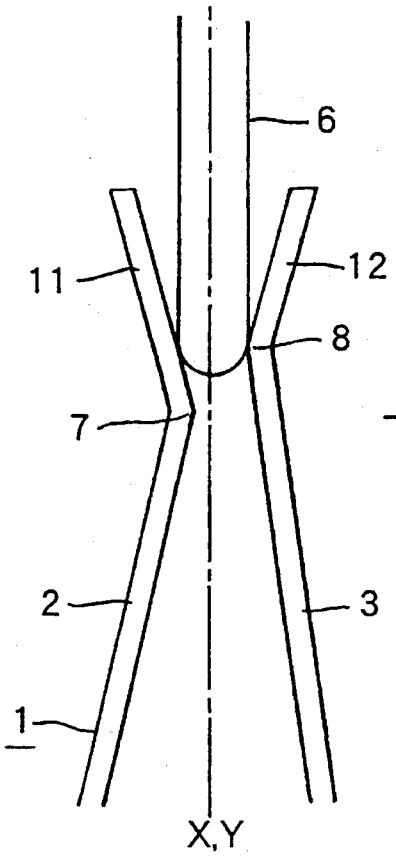
FIGS. 7(A) and 7(B) are front views of an important portion for explaining a process for introducing a lead pin into the electric contactors of FIGS. 5 and 6.

More specifically, as shown in FIG. 7(A), the lead pin 6 is guided by the second pressure receiving element 12 and press contacted with the second press contact portion 8 which occupies a higher position, while displacing the second resilient contact element 3 rearwardly against its resiliency. Then, the lead pin 6 is guided by the first pressure receiving element 11 and press contacted with the first press contact portion 7 which occupies a lower position relative to the second press contact portion 8 while displacing the first resilient contact element 2 against its resiliency.

Figure 7B:
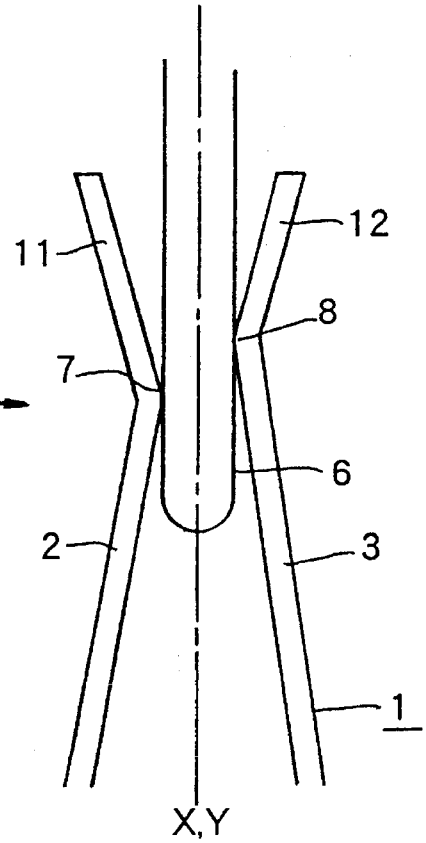
Figure 8:
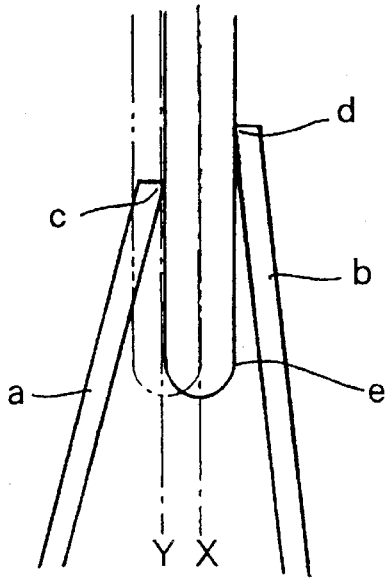
FIG. 8 is a reference view of an important portion for explaining a contacting state in which press contact positions formed by the electric contactor are vertically displaced relative to the lead pin.

That is, when inserted, the lead pin 6 is brought into contact with the first and second press contact portions 7 and 8 at different times. As a result, as shown in FIG. 7(B), the first and second resilient contact elements 2 and 3 are press contacted with opposite sides of the lead pin 6 with a generally equal resilient force. That is, the first and second press contact portions 7 and 8 resiliently clamp the lead pin 6 on a line where the axis X of the lead pin 6 is in alignment with the center line Y of the electric contactor 1.

According to the present invention, the first press contact portion of the first resilient contact element and the second press contact portion of the second resilient contact element are positionally displaced from each other in a direction axially of the lead pin, the length of the spring portion of the first resilient contact element is set to be different from the length of the spring portion of the second resilient contact element, and the spring constant of the first resilient contact element is set generally equal to the spring constant of the second resilient contact element. Accordingly, the lead pin can be clamped between the first resilient contact element and the second resilient contact element which are generally equal in amount of displacement and in contacting force. As a result, since the electric contactor is always held in alignment with the lead pin, it is always possible to achieve a stable electrical connection. Also, it is possible to achieve an appropriate electrical connection without an undue load being imposed on one of the first and second resilient contact elements and the lead pin. For example, even if the thickness of the lead pin is changed, the displacement amounts of the first and second resilient contact elements can be made equal. Since no undue load is imposed on one of the first and second resilient contact elements, it is possible to achieve a stable electrical connection.

According to the present invention, since the press contact positions relative to the lead pin are vertically displaced, it is not necessary to arrange the first and second press contact portions in an opposing relation with a very small distance therebetween as in the conventional electric contactor, and therefore the requirement for miniaturizing the lead pin can be effectively met. Also, even a very small lead pin can be clamped with a uniform press contacting force.

Furthermore, according to the present invention, since the first press contact portion and the second press contact portion are positionally displaced in a direction axially of the lead pin, they can be favorably subjected to metal plating. As a result, it is possible to provide satisfactory contacting surfaces.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, it should be understood that the present invention is not limited to the specific embodiments set out above but includes all possible embodiments which can be embodied within a scope set out in the appended claims and equivalents thereof.

What is claimed is:

1. An electric contactor comprising a first resilient contact element and a second resilient contact element extending in opposing relation to each other on opposite sides of a central axis, said first and second resilient contact elements being connected together at first ends thereof and unconnected at second ends thereof, said first and second resilient contact elements being provided at said second ends thereof with a first press contact portion and a second press contact portion, respectively, for resiliently clamping a lead pin of an electric part therebetween, said first and second press contact portions being positionally displaced with respect to each other along a direction of said central axis, said first resilient contact element comprising a first spring portion extending from said first press contact portion to said first end of said first resilient contact element, said second resilient contact element comprising a second spring portion extending from said second press contact portion to said first end of said second resilient contact element, said first spring portion being shorter in length than said second spring portion, a spring constant of said first resilient contact element being generally equal to a spring constant of said second resilient contact element, and said first resilient contact element being narrower in width than said second resilient contact element.

2. An electric contactor as claimed in claim 1, wherein each of said first contact portion and said second contact portion extend from a respective side of said central axis to a position beyond said central axis on the respective other side of said central axis.

* * * * *